US008317657B2

(12) United States Patent
Thukral et al.

(10) Patent No.: US 8,317,657 B2
(45) **Date of Patent: *Nov. 27, 2012**

(54) SYSTEM FOR ENCOURAGING A USER TO PERFORM SUBSTANTIAL PHYSICAL ACTIVITY

(75) Inventors: Dhruv Thukral, Santa Monica, CA (US); Michael J. Zyda, Carmel, CA (US); Chang Wei-Chung, Tainan (TW); Shu Fen Lin, Los Angeles, CA (US)

(73) Assignee: University of Southern California, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/157,071

(22) Filed: Jun. 9, 2011

(65) Prior Publication Data

US 2011/0262888 A1 Oct. 27, 2011

Related U.S. Application Data

(63) Continuation of application No. 12/256,679, filed on Oct. 23, 2008, now Pat. No. 7,980,997.

(51) Int. Cl.
*A63B 15/02* (2006.01)
*A63B 71/00* (2006.01)
*A63F 9/24* (2006.01)

(52) U.S. Cl. ..... 482/8; 482/1; 482/9; 463/1; 463/7

(58) Field of Classification Search ..... 600/587, 600/595; 482/1–9

See application file for complete search history.

(56) References Cited

U.S. PATENT DOCUMENTS 5,749,372 A 5/1998 Allen et al.
5,901,961 A 5/1999 Holland, III
5,954,512 A 9/1999 Fruge
6,024,675 A 2/2000 Kashiwaguchi
6,183,425 B1 2/2001 Whalen et al.
6,522,266 B1 2/2003 Soehren et al.
6,705,972 B1 3/2004 Takano et al.
6,749,432 B2 6/2004 French et al.
7,089,148 B1 8/2006 Bachmann et al.
7,980,997 B2 7/2011 Thukral et al.
2002/0103610 A1 8/2002 Bachmann et al.
2004/0167420 A1 8/2004 Song et al.
2005/0221960 A1 10/2005 Miyamaru et al.
2005/0272504 A1 12/2005 Eguchi et al.
2006/0020177 A1 1/2006 Seo et al.
2006/0025282 A1 2/2006 Redmann
2006/0167387 A1 7/2006 Buchholz et al.

(Continued)

OTHER PUBLICATIONS

BBC United Kingdom. 2007. Wii players need to exercise too. Article last updated Dec. 21, 2007. (Downloaded on Feb. 20, 2009 from http://news.bbc.co.uk/1/hi/health/7155342.stm).

(Continued)

*Primary Examiner* — Loan Thanh
*Assistant Examiner* — Sundhara M Ganesan
(74) *Attorney, Agent, or Firm* — McDermott Will & Emery LLP

(57) ABSTRACT

A system for encouraging a user to perform substantial physical activity. The system may include sensors that may be worn by the user while the user is performing a substantial physical activity, such as running or playing basketball. The sensors may detect the magnitude of the physical activity and may transmit data regarding the physical activity to a processing system. The processing system may display a reward to encourage the user for participating in physical activity and the reward provided may be based on the physical activity of the user.

15 Claims, 7 Drawing Sheets

U.S. PATENT DOCUMENTS

| | | | |
|---|---|---|---|
| 2006/0286522 | A1 | 12/2006 | Ng-Thow-Hing |
| 2007/0003915 | A1 | 1/2007 | Templeman |
| 2007/0042868 | A1 | 2/2007 | Fisher et al. |
| 2007/0087799 | A1 | 4/2007 | Van Luchene |
| 2007/0100666 | A1 | 5/2007 | Stivoric et al. |
| 2007/0111767 | A1 | 5/2007 | Brown et al. |
| 2007/0129148 | A1 | 6/2007 | Van Luchene |
| 2007/0173705 | A1 | 7/2007 | Teller et al. |
| 2007/0208232 | A1 | 9/2007 | Kovacs |
| 2007/0225071 | A1 | 9/2007 | Van Luchene et al. |
| 2007/0238499 | A1 | 10/2007 | Wright |
| 2007/0260984 | A1 | 11/2007 | Marks et al. |
| 2007/0281765 | A1 | 12/2007 | Mullen |
| 2008/0005775 | A1 | 1/2008 | Belton et al. |
| 2008/0029769 | A1 | 2/2008 | You |
| 2008/0076496 | A1 | 3/2008 | Baerlocher et al. |
| 2008/0125289 | A1 | 5/2008 | Pryor et al. |
| 2008/0139307 | A1 | 6/2008 | Ueshima et al. |
| 2008/0167535 | A1 | 7/2008 | Stivoric et al. |
| 2008/0216592 | A1 | 9/2008 | Ueda et al. |
| 2008/0221487 | A1 | 9/2008 | Zohar et al. |
| 2008/0311968 | A1 | 12/2008 | Hunter |
| 2009/0024062 | A1 | 1/2009 | Einarsson |
| 2009/0047644 | A1 | 2/2009 | Mensah et al. |
| 2009/0082701 | A1 | 3/2009 | Zohar et al. |
| 2009/0137933 | A1 | 5/2009 | Lieberman et al. |
| 2009/0299232 | A1 | 12/2009 | Lanfermann et al. |

OTHER PUBLICATIONS

Becque et al. Coronary risk incidence of obese adolescents: Reduction by exercise plus diet intervention. Pediatrics, vol. 81, No. 5, pp. 605-612.

Dietz, W. H. (1983). Childhood obesity: Susceptibility, cause, and management. Journal of Pediatrics, vol. 103, No. 5, pp. 676-686.

Epstein, et al. Long-term effects of family-based treatment of childhood obesity. Journal of Consulting and Clinical Psychology 1987, vol. 55, No. 1, pp. 91-95.

Graves, et al. An evaluation of parental problem-solving training in the behavioral treatment of childhood obesity. Journal of Consulting and Clinical Psychology 1988, pp. 246-250.

US Department of Health and Human Services, Office of Maternal and Child Health. (1989). Child Health USA '89. Washington, DC: U.S. Department of Health and Human Services, National Maternal and Child Health Clearinghouse. ED 314 421, pp. 1-51.

Wii Fit by Nintendo, Run. Selected screen shots from video of Wii Fit Run in use, from video uploaded to YouTube on May 27, 2008. (Downloaded on Nov. 12, 2011 from http://www.youtube.com/watch?v=A270WkVXUag).

Wii Fit by Nintendo. Article on Wikipedia, the free encyclopedia. Product released on Dec. 1, 2007, first disclosed as Wii Health Pack in mid-Sep. 2006. (Downloaded on Nov. 12, 2011 from http://en.wikipedia.org/wiki/Wii_Fit).

Wii Fit by Nintendo, Soccer Heading component. Selected screen shots from video uploaded to YouTube on Jan. 11, 2009 (Downloaded on Nov. 12, 2011 from http://www.youtube.com/watch?v=ygZaY_7WPd0).

Wii Fit by Nintendo, Hula Hoop component. Selected screen shots from video uploaded to YouTube on May 14, 2008 (Downloaded Nov. 12, 2011 from http://www.youtube.com/watch?v=Q84FLyWDSAE).

Wolf, et al. School-based interventions for obesity: Current approaches and future prospects. Psychology in the Schools 1985, vol. 22, pp. 187-200.

FIG. 10
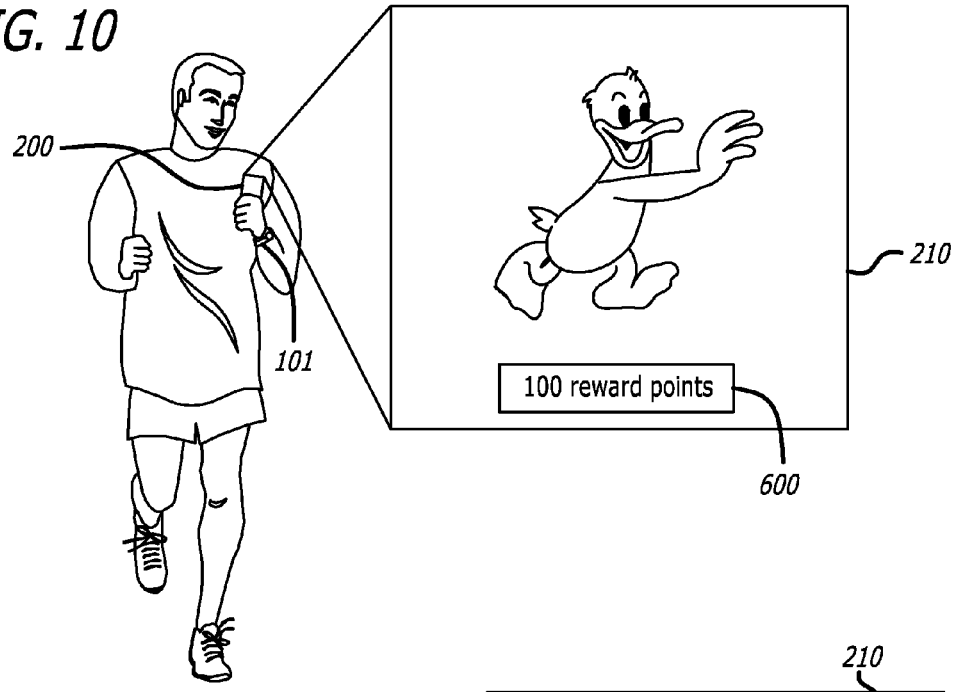
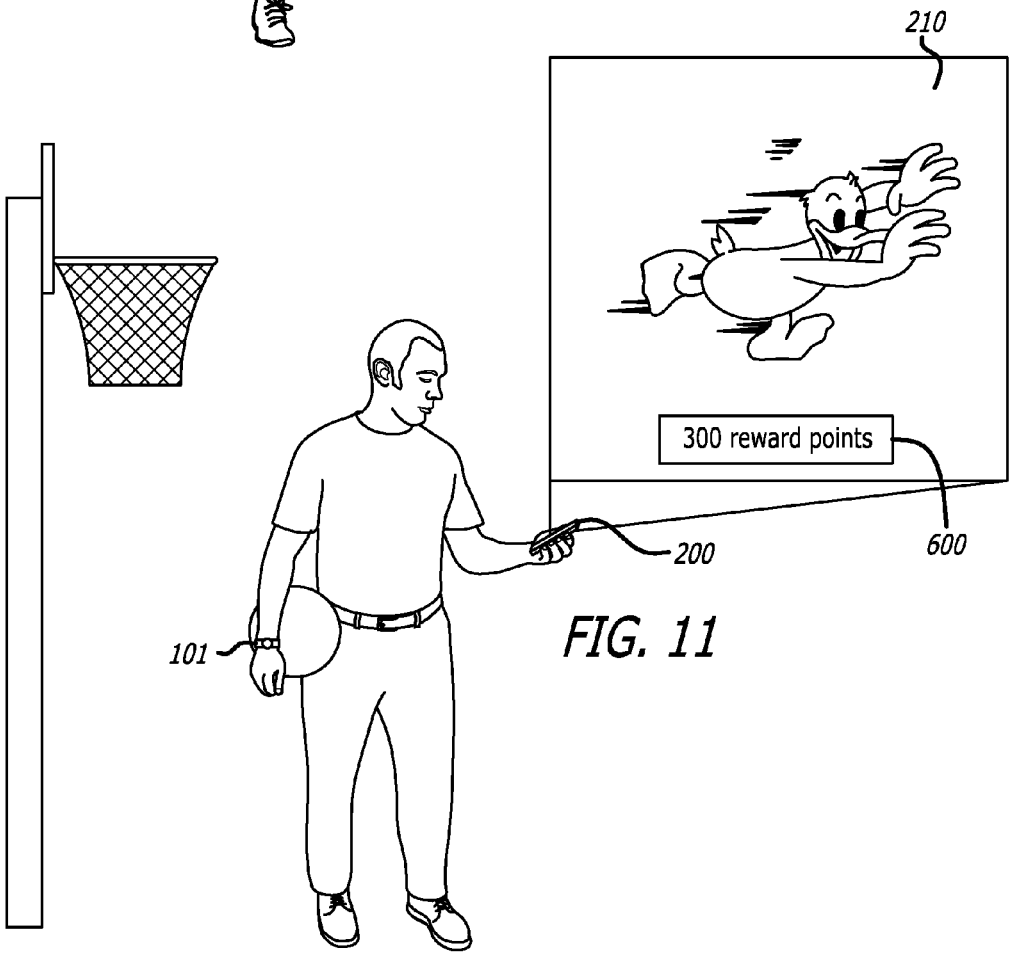
FIG. 11

SYSTEM FOR ENCOURAGING A USER TO PERFORM SUBSTANTIAL PHYSICAL ACTIVITY

CROSS-REFERENCE TO RELATED APPLICATIONS

This application is a continuation of U.S. application Ser. No. 12/256,679, filed Oct. 23, 2008 (now U.S. Pat. No. 7,980,997 B2, issued Jul. 19, 2011), entitled "System for Encouraging a User To Perform Substantial Physical Activity," the entire content of which is incorporated herein by reference.

BACKGROUND

1. Field

This application relates to an interactive system that encourages users to partake in substantial physical exercise.

2. Description of Related Art

Childhood obesity in America is on the rise. Between 5-25 percent of children and teenagers in the United States are obese (Dietz, 1983). As with adults, the prevalence of obesity in the young varies by ethnic group. It is estimated that 5-7 percent of White and Black children are obese, while 12 percent of Hispanic boys and 19 percent of Hispanic girls are obese (Office of Maternal and Child Health, 1989).

Obesity presents numerous problems for the child. In addition to increasing the risk of obesity in adulthood, childhood obesity is the leading cause of pediatric hypertension, is associated with Type II diabetes mellitus, increases the risk of coronary heart disease, increases stress on the weight-bearing joints, lowers self-esteem, and affects relationships with peers. These problems are compounded by the social and psychological problems faced by children as a consequence of childhood obesity.

The three main identified causes for childhood obesity are family, low-energy expenditure and heredity. While causes such as family and hereditary require long term commitments and research, an increase in energy expenditure in children as well as adults may achieve almost immediate positive results in combating obesity.

To accomplish increased physical activity, and thereby combat obesity, the following methods of intervention treatment have been identified as considerably valuable in combating obesity, regardless of the cause; Physical Activity, Diet Management and Behavior Modification.

Physical activity, through a formal exercise program, or simply becoming more active, is valuable for burning fat, increasing energy expenditure, and maintaining lost weight. Most studies of children have not shown exercise to be a successful strategy for weight loss unless coupled with another intervention, such as nutrition education or behavior modification (Wolf et al., 1985). However, exercise has additional health benefits. Even when children's body weight and fatness did not change following 50 minutes of aerobic exercise three times per week, blood lipid profiles and blood pressure did improve (Becque, Katch, Rocchini, Marks, & Moorehead, 1988).

Many behavioral strategies used with adults have been successfully applied to children and adolescents: self-monitoring and recording food intake and physical activity, slowing the rate of eating, limiting the time and place of eating, and using rewards and incentives for desirable behaviors. Particularly effective are behaviorally based treatments that include parents (Epstein et al., 1987). Graves, Meyers, and Clark (1988) used problem-solving exercises in a parent-child behavioral program and found children in the problem-solving group, but not those in the behavioral treatment-only group, significantly reduced percent overweight and maintained reduced weight for six months.

Some systems such as the Nintendo Wii™ allow the user to expend more energy than playing sedentary computer games. However the energy used when playing these games is not of high enough intensity to contribute towards the recommended daily amount of exercise in children (BBC, 2007). Nintendo's latest iteration of an Exergame, the Wii-Fit™, provides 40 different activities; however none of them involve any outdoor activity and still require the user to be located in front of a television in order to play the game. The Exergame system requires an initial investment of hundreds of dollars for a console and the game.

Other systems that help joggers and runner's capture their physical exercise activity are only limited to capturing exercise metrics from running. Systems such as Nike Plus™ also only target users who are already health conscious and are engaging in physical activity, and only need a visualization tool to help keep track of their own user defined goals. None of the systems in the above category is tasked at educating and encouraging users to undergo substantial physical exercise, and at the same time keep them engaged.

Therefore a need exists for a system targeted towards addressing obesity, and childhood obesity in particular, using a medium that is successful with children and teenagers.

SUMMARY

A system for encouraging a user to perform substantial physical activity may comprise one or more sensors that are configured to be worn by the user while the user is performing the physical activity. The one or more sensors may be configured to detect the magnitude of the physical activity, including movement of the user in one or more directions. The system may also comprise a user interface that is configured to provide a reward to the user for performing a substantial physical activity, other than a report about the physical activity. The system may further comprise a processing system configured to cause the user interface to provide the reward to the user based on the magnitude of the physical activity as detected by the one or more sensors. The reward generated by the user interface may be configured to display an animated game comprising an animated character, and the actions of the animated character may be correlated to the physical activity of the user.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

FIG. 10 illustrates system of FIG. 1 in use while the user of FIG. 9 is jogging with a reward shown on the user interface.

FIG. 11 illustrates system of FIG. 1 in use while the user of FIG. 9 is playing basketball with an increased reward.

DETAILED DESCRIPTION OF ILLUSTRATIVE EMBODIMENTS

Illustrative embodiments are now discussed. Other embodiments may be used in addition or instead. Details that may be apparent or unnecessary may be omitted to save space or for a more effective presentation. Conversely, some embodiments may be practiced without all of the details that are disclosed.

Figure 1:
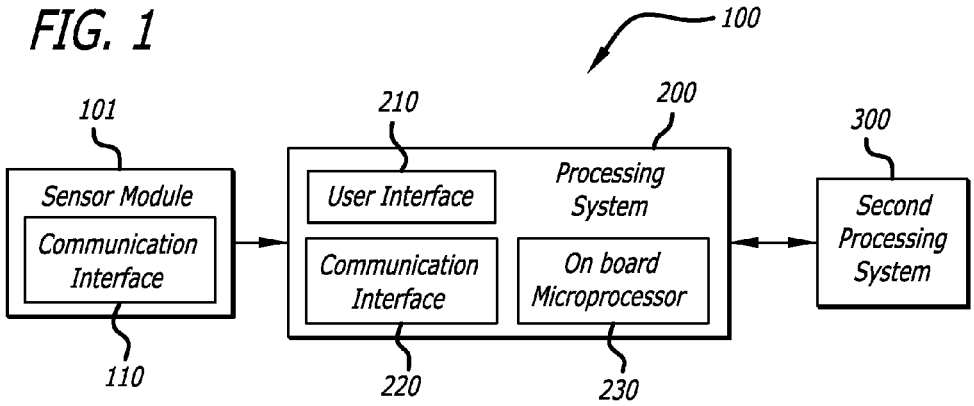
FIG. 1 illustrates a block diagram of a system for encouraging a user to perform substantial physical activity.

FIG. 1 illustrates a system for encouraging a user to perform substantial physical activity 100. As illustrated in FIG. 1, a system for encouraging a user to perform substantial physical activity 100 may consist of a sensor module 101, a processing system 200 and a second processing system 300. The components of the system 100 may be configured to be worn or held in the hand of the user and therefore may allow the user to participate in indoor and outdoor physical activities such as sports and other substantial physical activities.

The sensor module 101 may comprise a sensor or groups of sensors 125, 130, 135. The sensor(s) 125, 130, 135 may be configured to detect the magnitude of the physical activity in form of health vectors.

As used herein, a health vector may be a quantifiable snapshot of the person's physical and biological state as determined by the data gathered by the sensors, and the information extracted by the algorithms that process that data. A health vector may contain various dimensions, of which each dimension may reveal a quantifiable aspect of a person's overall health and provide the magnitude of the physical activity of the user.

A health vector may contain the following magnitude of physical activity in the form of Calories Burnt, Distance traveled, Duration of Exercise, Duration spent outdoors and Duration spent indoors. A health vector may be easily accommodated to add more dimensions on a per need basis.

Figure 2:
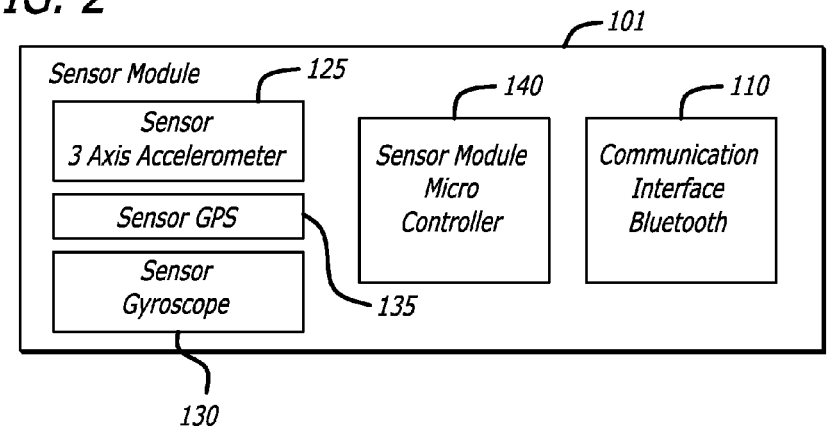
FIG. 2 illustrates a detailed block diagram of the sensor module the system of FIG. 1.

As shown in detail in FIG. 2 the sensor or group of sensors 125, 130, and 135 may include a 3 Axis Accelerometer 125, a Gyroscope 130, and a GPS sensor 135. The sensor module 101 may also include an on board microcontroller 140 and a communication interface 110 which may act as a wireless communication interface that may communicate information gathered by the sensor(s) 125, 130 and 135 to a processing system 200.

The sensor module may be in the form of a wearable device, for example, a wrist watch, pendant or bracelet.

The processing system 200 may be a device with a communication interface 220 of its own, a user interface 210 and an on board microprocessor 230. The communication interface 220 of the processing system 200 may receive the information gathered by the sensor(s) 125, 130 and 135 of the sensor module 101. As used herein, a processing system 200 may be any system capable of receiving raw data regarding the physical and/or biological state of the user.

The processing system 200 may also be capable of being held in the hand of the user and may have the ability to receive the information gathered by the sensor(s) 125, 130 and 135 of the sensor module 101. Examples of a the hand held processing system may include a cell phone, mp3 player, personal digital assistant (PDA), hand held video game or hand held computer.

The processing system 200 microprocessor 230 may run algorithms on the information gathered by the sensor(s) 125, 130 and 135 of the sensor module 101 to extract quantifiable dimensions of health vector of the user. The microprocessor 230 may also run various gesture algorithms that may identify the form of physical activity the user is performing in real time.

Examples of physical gesture recognition algorithms that may run on the physical sensor data may include various substantial physical activities including sports, such as walking, running, jumping and biking.

For example, the microprocessor 230 may run various gesture algorithms to identify that the user is running, riding a bicycle, swimming, jumping rope, playing basketball or other sports or physical activities. This real time recognition may be fed into a user interface 210 which may reward the user for participating in substantial physical activity.

The user interface 210 may be an animated game with an animated character that may respond to physical activity conducted by the user, and base the animated character's daily health on the level of physical activity of the user. If at any point in the game the user neglects physical exercise, the game 210 may respond with a negative feedback for the animated character, until ultimately the animated character may abandon the user due to lack of physical exercise. A health vector may be the standard form of information that may be consumed within the game to determine the extent of in game progress and/or rewards.

The user interface 210 may also correlate the actions of the animated character on the gesture algorithms run by the microprocessor 230. For example, if the user is jumping rope, the microprocessor will identify this activity and the user interface will generate an animated character that is also jumping rope.

Continued dedication to physical activity may be rewarded by growing an in game economy that may be used to unlock new features and enhancements for the animated characters.

Examples of rewards generated by the user interface 210 may include animated games, featuring animated characters and animated scenes; and reward points. The actions of the animated characters may be correlated to the actions of the user participating in substantial physical activity. New animated scenes and animated characters may be added by the user interface as rewards for the user participating in substantial physical activity. The animated characters and animated scenes may be deleted based on a decrease or lack of substantial user physical activity.

The system 100 may also include the ability to gather game data and statistics of the game play, and communicate that data and/or information to another processing system 300.

The gathered data and/or information can then be used by the users to create visualizations and statistics of their own physical activities they have performed while playing the game, and to measure those activities.

Figure 3:
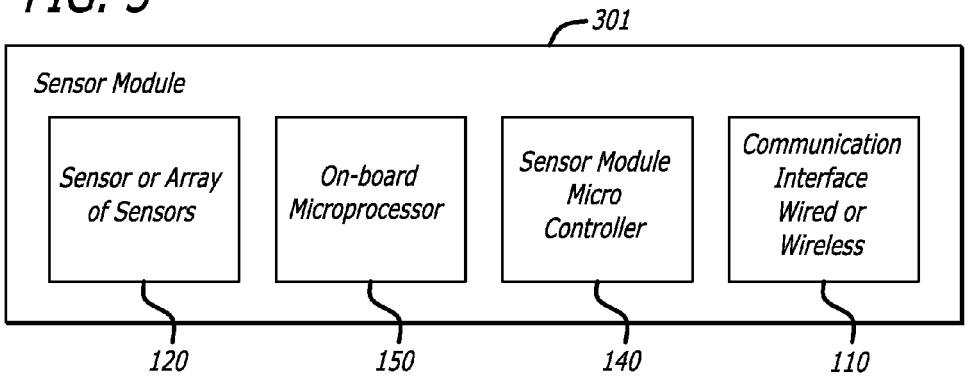
FIG. 3 illustrates a block diagram of a sensor module with an onboard processor and a wired and/or wireless communication interface.

As illustrated in FIG. 3, a sensor module 301 may include a sensor or sensor(s) 120 that may be coupled with an on board microprocessor 150 or a microcontroller 140 configured to directly act on the data fed to it by the sensor(s) 120 by running pre-defined algorithms. In this configuration, the task of calculating the health vector and real time gesture recognition may be offloaded from the microprocessor 230 on the processing system 200, and be fed directly into the user interface 210 through a wired or wireless communication interface 110.

Figure 4:
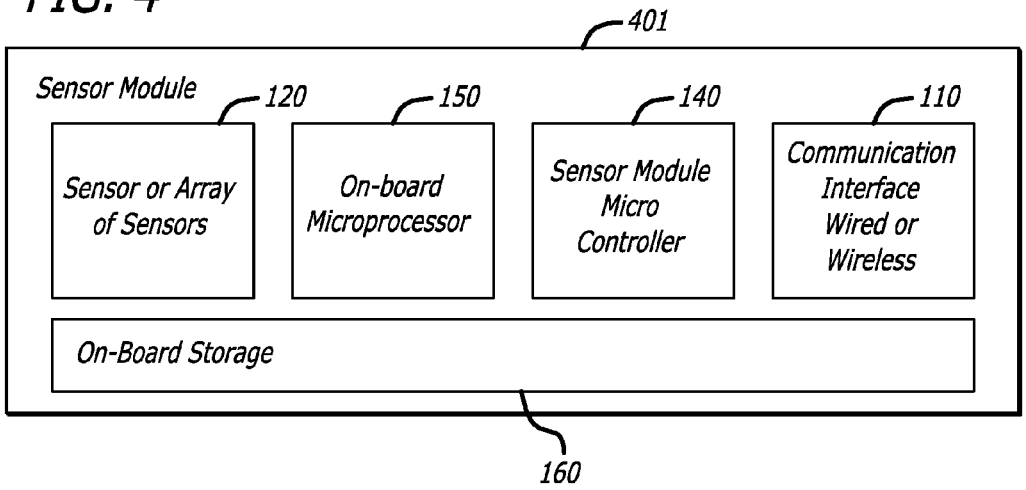
FIG. 4 illustrates a block diagram of a sensor with a wired and/or wireless communication interface and on board storage.

As illustrated in FIG. 4, a sensor module 401 may include sensor(s) 120, which may be coupled to a removable storage media 160, which can store data gathered from the sensor(s) 120 and/or also store health vector and gesture recognition information, the later may be possible if the sensor(s) 120 are coupled to an on board microprocessor 150 or a sophisticated microcontroller 140. This may allow the sensor(s) 120 to have the ability to store such information for a period of unspecified time and communicate the information when needed through a wired or wireless communication interface 110, allowing for offline operation instead of real time operation of the system.

Figure 5:
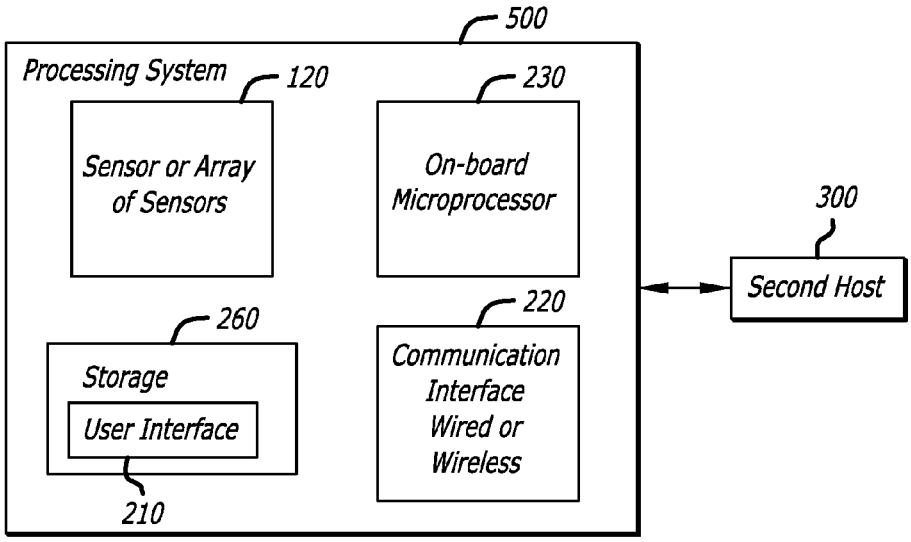
FIG. 5 illustrates system for encouraging a user to perform substantial physical activity without a separate sensor module.

FIG. 5 illustrates a single processing system 500 for encouraging a user to participate in substantial physical activity that may be contained within the single processing system 500. This processing system 500 may contain within it a sensor or array of sensors 120, which may gather data of the physical and/or biological state of the user. The processing system 500 may store the data for later processing in a storage component 260, or use an on-board microprocessor 230 to run pre-determined algorithms, and then store in its storage component 260 the resulting health vector and gesture recognition information for later use. The algorithms running on the microprocessor 230 may be a part of a user interface 210 stored in the storage component 260 of the processing system 500, or may be a part of a separate suite within the processing system 260. The microprocessor 230 may also run various algorithms in real time. This real time recognition may be fed into the user interface 210 to affect in the generate rewards on the user interface 210 that may be based on the substantial physical activity of the user. Alternatively, the information may be fed delayed offline to the user interface 210 by accessing the information from the storage 260 component of the processing system 500. The system 500 illustrated in FIG. 5 may also include the ability to gather data and statistics of the, and communicate that data and/or information to another processing system 300. The gathered data and/or information may then be used by the users to create visualizations and statistics of their own physical activities they have performed, and to measure those activities. The user's visualizations and statistics may also be used by healthcare experts and counselors to better track the progress made by the users towards reducing obesity, and to also suggest improvements and alternate regimens, which may be programmable from within the user interface 210.

Figure 6:
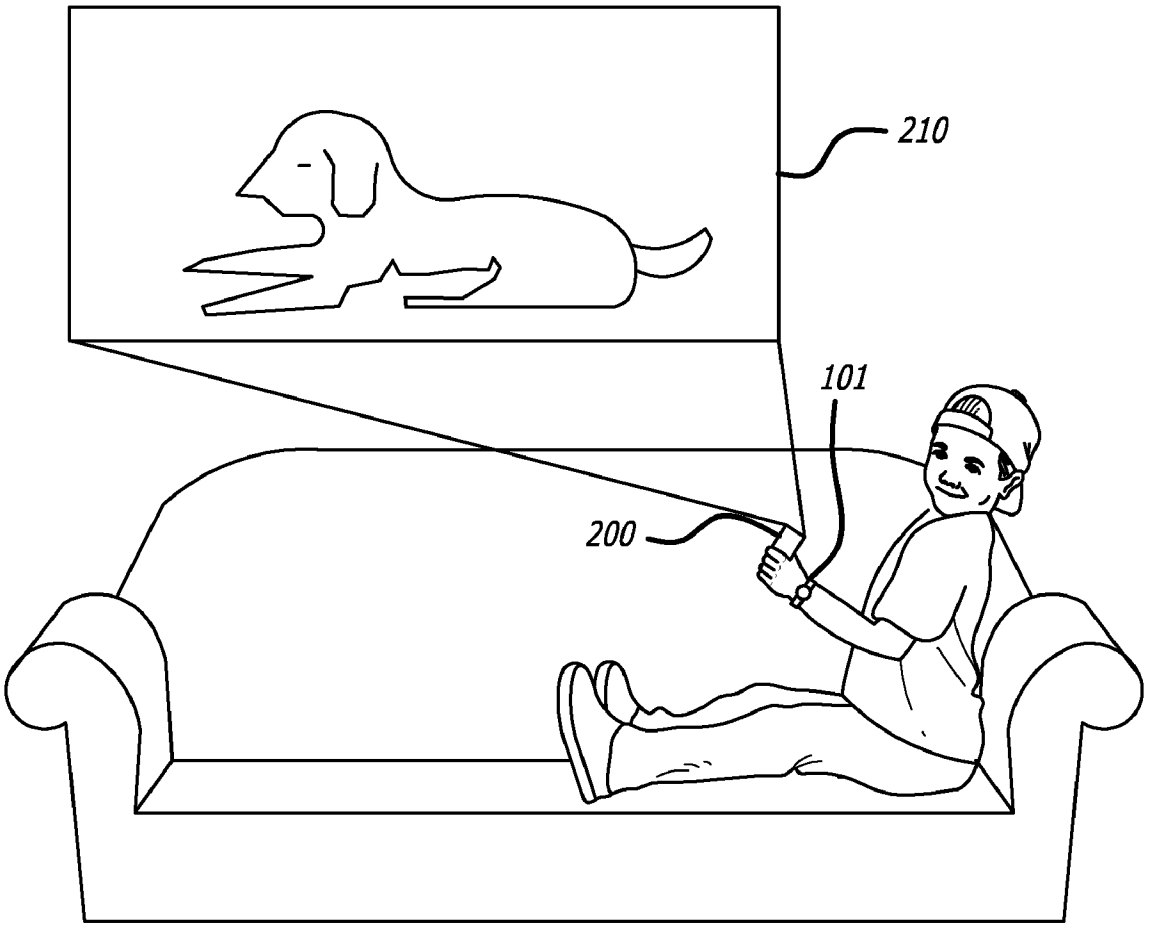
FIG. 6 illustrates the sensor system of FIG. 1 in use by a user not participating in substantial physical activity.

FIG. 6 illustrates the use of any one of the systems for encouraging a user's participation in significant physical activity of FIG. 1 or FIG. 3, in which the user is shown wearing the sensor module 101 and holding the processing system 200. As shown in FIG. 6, the user is stationary and the user interface generates an animated character which is also shown on the display to be stationary.

Figure 7:
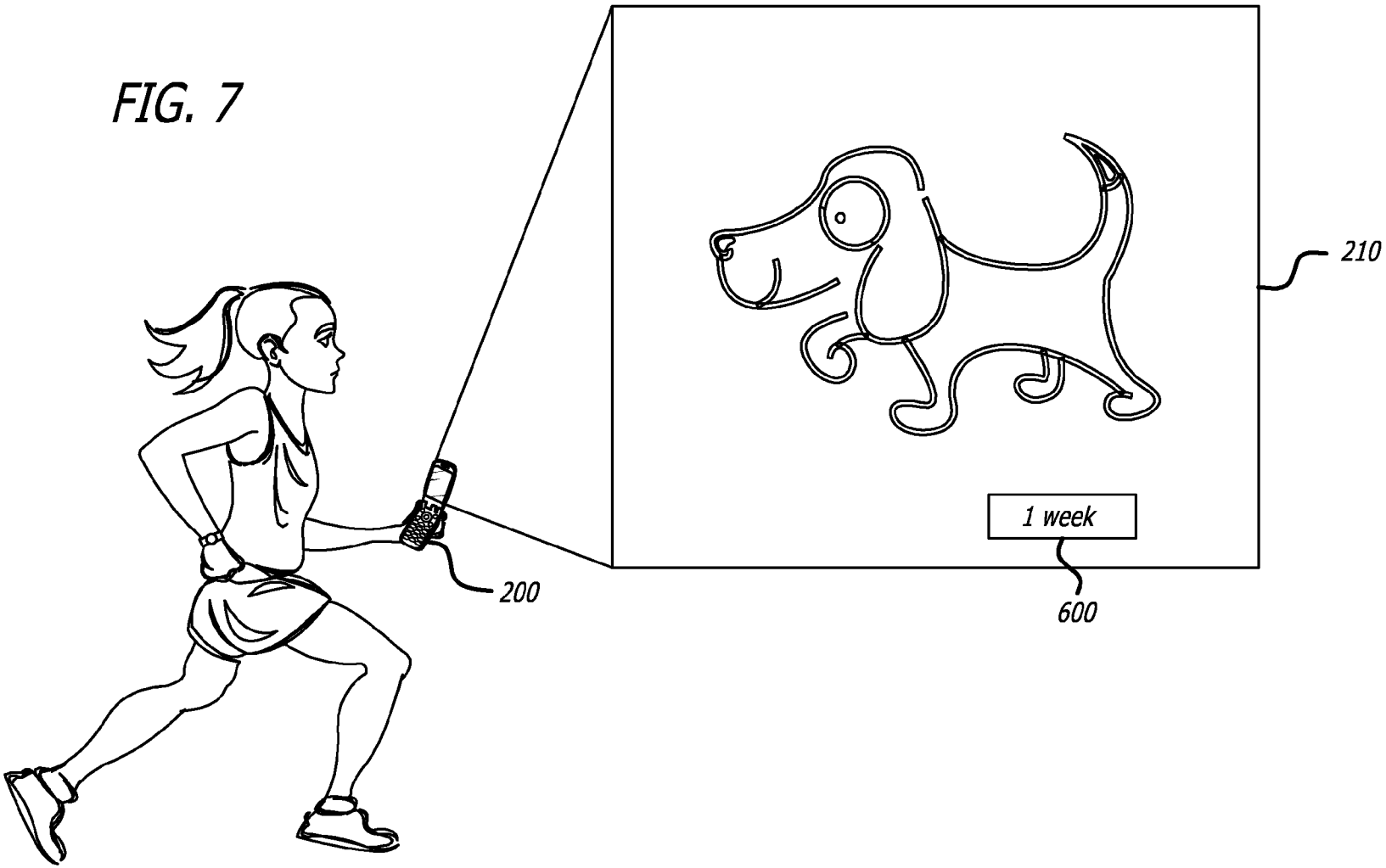
FIG. 7 illustrates the sensor system of FIG. 1 in use while the user is running.
Figure 8:
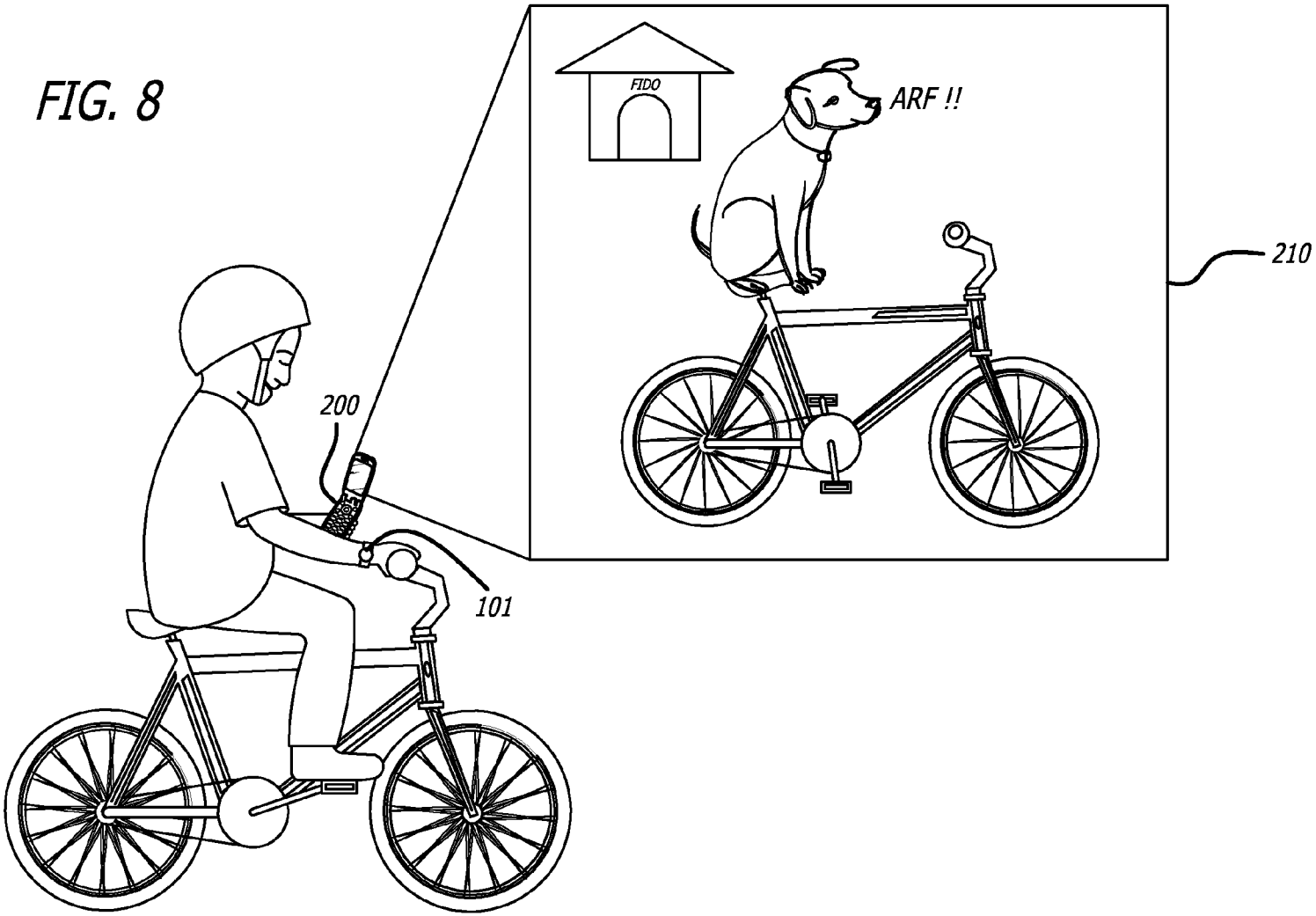
FIG. 8 illustrates the sensor system of FIG. 1 in use while the user is riding a bicycle.

FIGS. 7 and 8 illustrate the use of any one of the systems of FIGS. 1-5, in which the user is running and the user interface generates a reward in the form of an animated character. The actions of the animated character shown on the processing are shown to be based on the user's physical movement, thereby providing a reward to the user for participation in substantial physical activity. The animated character generated by the user interface may have characteristics different from those of any other animated character used in any other system. The user interface may generate an initial life-span 600 for the animated character, which may be increase or reduced based on the physical activity of the user. The life span 600 of the animated character may be increased based on the user's increased participation in substantial physical activity or the type of physical activity of the user. The life span of the animated character may be decreased based on a decrease or lack of participation in substantial physical activity of the user. The user interface may also reward the user by generating animated objects or gifts 601 for the animated character as illustrated in FIG. 8. These object or gifts may be added or removed based on the substantial physical activity of the user. The user interface may also generate new animated games featuring new animated characters and scenes based on the substantial physical activity of the user.

Figure 9:
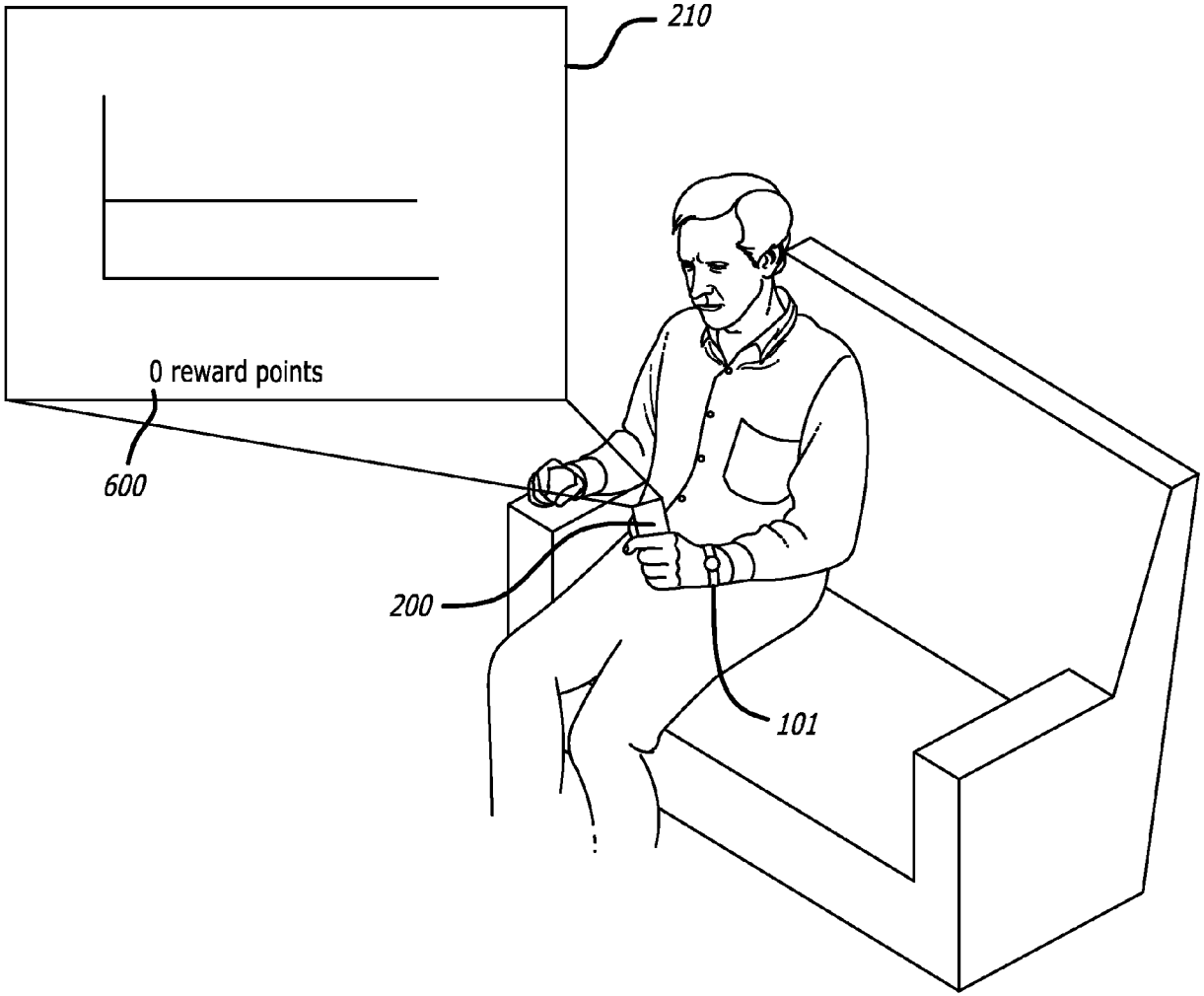
FIG. 9 illustrates the sensor system of FIG. 1 in use while the user is not participating in substantial physical activity with no reward.

FIG. 9 shows a user who has not participated in any physical activity since using the systems as shown in FIGS. 1-5, and who has not received any reward points by the processing system.

FIG. 10 shows the same user of FIG. 9 shown running and viewing a user interface which provides a reward in the form of animated character and points. FIG. 11 illustrates the user of FIGS. 9 and 10 with an increased reward point tally based on participating in more substantial physical activity.

It will be recognized by those skilled in the art that the variations of the above-described sensors may readily be manufactured with conventional techniques of the type typically used in manufacturing sensor based solutions. Furthermore it is recognized by those skilled in the art that the communication interfaces of the wired and wireless type not restricted to the ones mentioned can be easily integrated with the above described configurations. It also will be recognized by those skilled in the art that various other types of processing systems can be built and, in addition, that numerous other changes can be made in the hardware and software embodiments described herein without departing from the scope and the spirit of the disclosed subject matter.

The term "coupled" encompasses both direct and indirect coupling. For example, the term "coupled" encompasses the presence of intervening circuitry between two points that are coupled. Nothing that has been stated or illustrated is intended to cause a dedication of any component, step, feature, object, benefit, advantage, or equivalent to the public, regardless of whether it is recited in the claims. In short, the scope of protection is limited solely by the claims that now follow. That scope is intended to be as broad as is reasonably consistent with the language that is used in the claims and to encompass all structural and functional equivalents.

The invention claimed is:

1. A system for encouraging a user to perform substantial body movement, comprising:

one or more sensors configured to detect substantial body movement of a user;

a display configured to display a moving animated character; and a processing system configured to cause the display to display the animated character performing substantial body movement the mimics the substantial body movement detected by the one or more sensors, wherein the processing system:

contains physical motion-recognition algorithms that are configured to determine the type of the substantial body movement that the one or more sensors detect the user is performing; and is configured to cause the display to display the animated character performing substantial body movement of the same type that the physical motion-recognition algorithms determine the user is performing.

2. The system for encouraging a user to perform substantial body movement of claim 1 wherein the physical motion-recognition algorithms are configured to determine that walking and running are different types of substantial body movements.

3. The system for encouraging a user to perform substantial body movement of claim 1 wherein the physical motion-recognition algorithms are configured to determine that running and jumping are different types of substantial body movements.

4. The system for encouraging a user to perform substantial body movement of claim 1 wherein the physical motion-recognition algorithms are configured to determine that running and bicycling are different types of substantial body movements.

5. The system for encouraging a user to perform substantial body movement of claim 1 wherein:

the physical motion-recognition algorithms are configured to determine that the user is not performing any substantial body movement when the one or more sensors fail to detect that the user is performing substantial body movement; and the processing system is configured to cause the display to display the animated character not performing any type of substantial body movement when the physical motion-recognition algorithms determine that the user is not performing any substantial body movement.

6. The system for encouraging a user to perform substantial body movement of claim 1 wherein the processing system is configured to determine a reward for the user based on the type of substantial body movement that the physical motion-recognition algorithms determine the user is performing.

7. The system for encouraging a user to perform substantial body movement of claim 6 wherein the physical motion-recognition algorithms are configured to determine that walking and running are different types of substantial body movements.

8. The system for encouraging a user to perform substantial body movement of claim 6 wherein the physical motion-recognition algorithms are configured to determine that running and jumping are different types of substantial body movements.

9. The system for encouraging a user to perform substantial body movement of claim 6 wherein the physical motion-recognition algorithms are configured to determine that running and bicycling are different types of substantial body movements.

10. The system for encouraging a user to perform substantial body movement of claim 6 wherein:

the physical motion-recognition algorithms are configured to determine that the user is not performing any substantial body movement when the one or more sensors fail to detect that the user is performing substantial body movement; and the processing system is configured not to provide any reward to the user when the physical motion-recognition algorithms determine that the user is not performing any substantial body movement.

11. The system for encouraging a user to perform substantial body movement of claim 6 wherein:

the physical motion-recognition algorithms are configured to determine a health vector from the substantial body movement detected by the one or more sensors that is indicative of the effect of the substantial body movement on the user's health in multiple categories; and the processing system is configured to determine the reward based on the health vector determined by the physical motion-recognition algorithms.

12. The system for encouraging a user to perform substantial body movement of claim 11 wherein one of the multiple categories is calories burnt, distance traveled, duration of substantial body movement, duration spent outdoors, or duration spent indoors.

13. The system for encouraging a user to perform substantial body movement of claim 11 wherein the multiple categories includes at least two of the following: calories burnt, distance traveled, duration of substantial body movement, duration spent outdoors, or duration spent indoors.

14. Non-transitory, tangible, computer-readable storage media containing a program of instructions containing algorithms configured to cause a computer processing system running the program of instructions to encourage a user to perform substantial body movement by causing a display to display an animated character performing substantial body movement that mimics the substantial body movement of the user as detected by one or more sensors, the program of instructions including physical motion-recognition algorithms that are configured to determine the type of the substantial body movement that the user is performing, and to cause the display to display the animated character performing substantial body movement of the same type that the physical motion-recognition algorithms determine the user is performing as detected by the one or more sensors.

15. The non-transitory, tangible, computer-readable storage media of claim 14 wherein the program of instructions contains algorithms configured to determine and provide a reward for the user based on the type of substantial body movement that the physical motion-recognition algorithms determine the user is performing.

* * * * *